US008042972B2

(12) United States Patent
Joergensen et al.

(10) Patent No.: US 8,042,972 B2
(45) Date of Patent: Oct. 25, 2011

(54) LIGHT ASSEMBLIES

(75) Inventors: Dennis Thykjaer Joergensen, Roende (DK); Martin Soerensen, Roende (DK); Heidi Marianne Hyldahl, Aarhus N (DK)

(73) Assignee: Martin Professional A/S, Aarhus N (DK)

( * ) Notice: Subject to any disclaimer, the term of this patent is extended or adjusted under 35 U.S.C. 154(b) by 131 days.

(21) Appl. No.: 11/817,282

(22) PCT Filed: Oct. 14, 2006

(86) PCT No.: PCT/DK2006/000578
§ 371 (c)(1),
(2), (4) Date: Jan. 15, 2008

(87) PCT Pub. No.: WO2007/045242
PCT Pub. Date: Apr. 26, 2007

(65) Prior Publication Data

US 2008/0158884 A1 Jul. 3, 2008

(30) Foreign Application Priority Data

Oct. 19, 2005 (DK) ..... 2005 01465

(51) Int. Cl.
*F21S 8/00* (2006.01)

(52) U.S. Cl. ..... 362/268; 362/277; 362/281

(58) Field of Classification Search ..... 362/268, 362/277; 359/724, 619–628
See application file for complete search history.

(56) References Cited

U.S. PATENT DOCUMENTS

| | | | | |
|---|---|---|---|---|
| 5,138,540 | A | 8/1992 | Kobayashi et al. | |
| 5,567,034 | A * | 10/1996 | Dietewich et al. | 362/512 |
| 6,282,027 | B1 | 8/2001 | Hough | |
| 6,976,772 | B2 * | 12/2005 | Albou et al. | 362/510 |
| 2001/0055209 | A1 * | 12/2001 | Dedoro | 362/293 |
| 2002/0114160 | A1 | 8/2002 | Weigert et al. | |
| 2005/0135106 | A1 | 6/2005 | Kittelmann et al. | |

FOREIGN PATENT DOCUMENTS

| | | | |
|---|---|---|---|
| EP | 1 167 868 | A2 | 1/2002 |
| EP | 1 384 941 | A2 | 1/2004 |
| JP | 2002-90822 | A | 3/2002 |
| JP | 2004-69723 | A | 3/2004 |

* cited by examiner

*Primary Examiner* — Evan Dzierzynski
(74) *Attorney, Agent, or Firm* — Roberts Mlotkowski Safran & Cole, P.C.; David S. Safran

(57) ABSTRACT

A method for forming a light beam, and a light assembly having at least one light source with a fixed reflector which directs a beam of light light assembly having a front lens, and a light deflecting mechanism for changing the light angle of the light beam after passing through the front lens. The front lens has a central part that differs from the surrounding parts of the front lens, and the light deflecting mechanism, in a first position, concentrates the light beam into the central part of the front lens to generate a wide-angle light beam, and in a second position, distributes the light beam over the entire front lens to generate a narrow angle light beam. The light deflecting mechanism is connected with a first actuator, and is movable between the first and the second position.

15 Claims, 9 Drawing Sheets

LIGHT ASSEMBLIES

FIELD OF THE INVENTION

Figure 1:
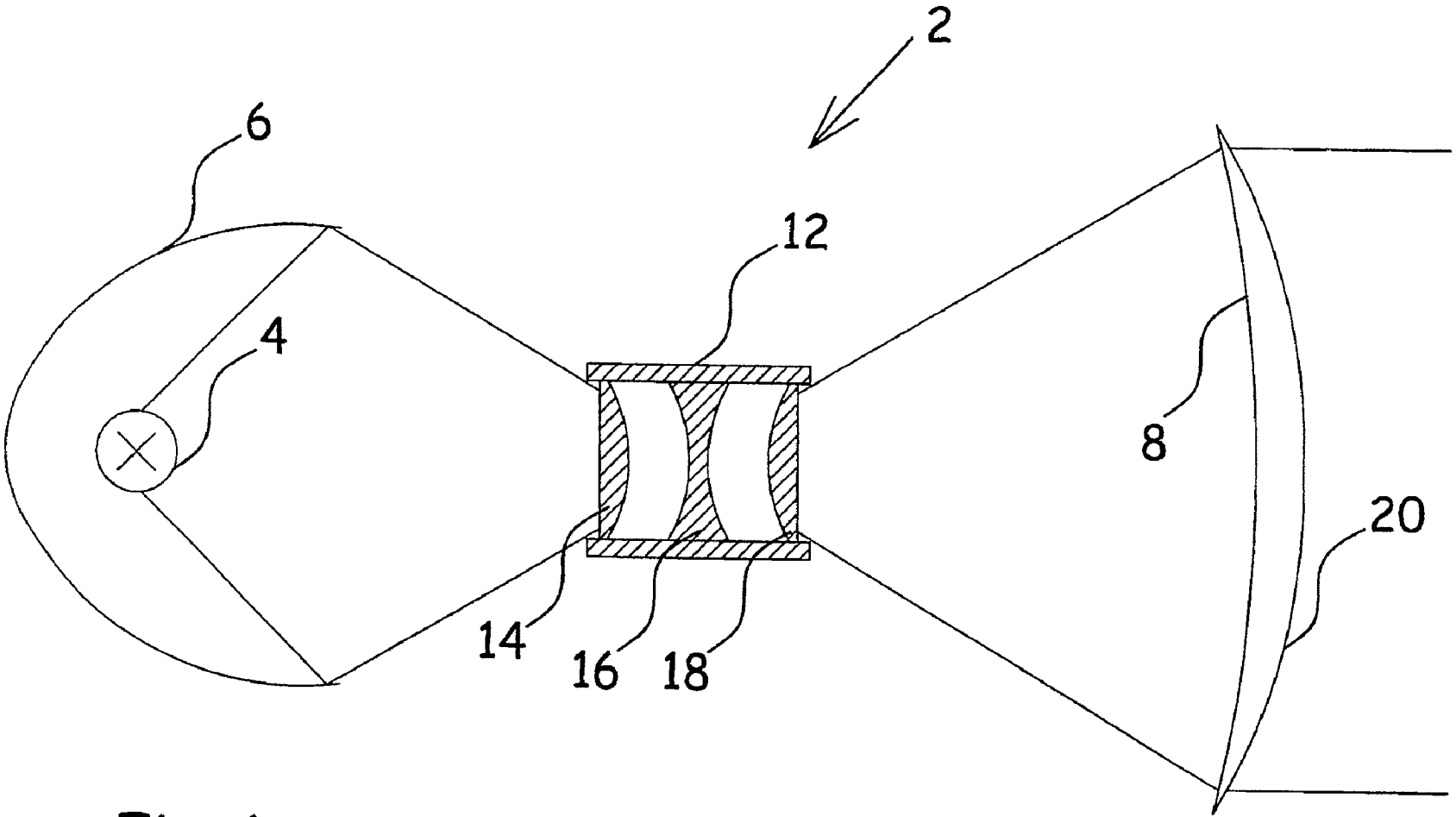

The present invention relates to a light assembly and a method comprising at least one light source which generates a beam of light into the light forming means and a light forming means at least comprising a light deflecting means for changing the angular and spatial distribution of the light hitting the front lens.

BACKGROUND OF THE INVENTION

U.S. Pat. No. 6,808,969 B2 concerns a first multiple lens array designed with positive-power lenses producing multiple bundles of converging light rays and a second multiple lens array designed with negative-power lenses producing multiple bundles of collimated light rays at a certain optimal separation between the two multiple lens arrays. As the axial separation between the two multiple lens arrays increases, the divergence of the entire beam of light increases. A black mask around the lenses reduces the effective light effect by converting the light into heat.

US20050135106A1 concerns a fresnel lens spotlight comprising an emergent light bundle having an adjustable aperture angle, a reflector, a lamp and at least one fresnel lens, wherein the at least one fresnel lens has a diffusing screen. The fresnel lens spot-light forms an adjustable aperture angle of the emergent light bundle. The fresnel lens spotlight preferably comprises an ellipsoidal reflector, a lamp and at least one fresnel lens to provide a homogeneously illuminated light field, where the fresnel lens has a diffusing screen.

To achieve a zoom effect, as described above, the reflector, the lamp or the front lens are movable. It is critical in a moving head light fixture to move heavy components because the centre of mass is moved during operation of the light assembly.

Movement of a front lens, a lamp or a reflector can lead to a change in the air flow inside the light assembly. Movement of the front lens can lead to a change of the air flow in the light assembly.

OBJECT OF THE INVENTION

The object of the invention is to achieve a light assembly with a variable spread angle, where major optical components are mechanically fixed in relation to a housing for achieving a light assembly, where the centre of mass changes only slightly during operation. A further object is to achieve a closed light assembly having openings in the case only for cooling, which can be achieved with a fixed front lens.

DESCRIPTION OF THE INVENTION

This can be achieved by a light assembly as described in the opening paragraph if the light deflecting means in a first position concentrates the light beam into the central part of the front lens to generate a wide-angle light beam, where the light deflecting means in a second position distributes the light beam over essential the entire front lens to generate a narrow-angle light beam, where the light deflecting means is movable between the first and the second position, where the light deflecting means is able to operate in different positions between the first and second position.

Because of the internal light deflecting means, the front lens does not need to be movable. Furthermore, the reflector and the light source are held in a fixed but adjustable position.

This may result in constant control of the air flowing around the optical components. The light deflecting means can operate in a closed volume. This way, the dirt collected on the surfaces of the optical components is reduced. Furthermore, the front lens can be placed so that the back of the front lens becomes part of the closed volume. The light assembly can be used in a moving head fixture on stage, or it could be used in a floodlight.

The light deflecting means can be positioned between the first and second position by a first actuator. The actuator can be controlled by computer means, which might control further activities in the lamp.

Preferable the front lens can have a central part with optical properties which differs from that of the surrounding parts of the front lens. A very efficient wash light zoom system can hereby be achieved.

The central part of the front lens can be formed with an optical characteristic which varies with respect to the position on the central part. This can lead to a soft change In the resulting light beam when the light deflecting means is moved between the first and second position.

An additional optic component is placed behind the central part of the front lens for obtaining different optical properties in the central part of the front lens. Thus an ordinary front lens can be applied. In this way, the characteristics of the light assembly can be changed by just replacing or removing the additional optic component. The additional optic component can be of a relative small diameter compared to the front lens. Such a component is relatively cheap and light weight. The tooling cost for the productions of such a component is also reduced compared to that of a complete front lens.

The additional optic component can be placed behind the central part of the front lens and may be moved in and out of the light beam by means of second actuating means. The additional optic component can in this way operate in or be moved outside the light beam to be inefficient in other situations. It is hereby achieved that the characteristics of the light assembly, can work in different regimes, for which the spread angle range and light distribution can be different.

The central part of the front lens can be formed as a diffusion lens. An efficient way of creating a wash light zoom is to combine the light deflecting means and a front lens having a central diffusion area. If the zoom system is in a position where the light beam is concentrated at the central diffusion area of the front lens, the light transmitted through the diffusion lens is spread in a wide angle. If the light deflecting means is placed in its opposite position, the light hits the entire area of the front lens, and only a limited amount of light passes the diffusing central section of the front lens.

As an alternative, the central part of the front lens can be an ordinary lens having a spherical or aspherical surface, where a diffusion lens can be placed behind the central part of the front lens.

The light deflecting means can comprise at least one fresnel lens. The fresnel lens is cheap in use, and it reduces the weight of the lens. By using the fresnel lens the moving mass of the light deflecting means is reduced.

The light deflecting means may also comprise at least one lens which surfaces can be described as general Aspheres, where spherical surfaces is included as special cases. By using at least one general aspherical lens the light deflecting means can make a more well-defined concentration of the light beam into the central part of the front lens compared to using a fresnel lens. The light deflecting means will probably consist of a number of lenses, which lenses surfaces are general aspheres. One or more or in some situations all of the components in the light deflecting means can be fresnel lenses, which may result in a lightweight light deflecting means.

According to a preferred embodiment the diffusion lens can be mechanically connected to the light deflecting means, where the diffusion lens can be moved in and out of the light beam by means of the second actuator. By placing the diffusion lens in conjunction to the light deflecting means, the diffusion lens can be moved into the light beam regardless of the position of the light deflecting means. It is hereby achieved that the diffusion lens operates with all light angles from the light assembly.

Instead, a rotating beam shaper can be mechanically connected to the light deflecting means, where the rotating beam shaper can be moved in and out of the light beam by means of a third actuator. Furthermore, as previously described, the rotating beam shaper can be applied regardless of the light deflecting means position.

According to a method for forming a light beam as described in the first paragraph, the light deflecting means can in a first position concentrate the light beam into the central part of the front lens to generate a wide-angle light beam, where the light deflecting means in a second position can spread the light beam over mostly the entire front lens to generate a narrow-angle light beam, and where the light deflecting means is movable between the first and the second position by means of first actuating means. The use of the light deflecting means in combination with a wash light makes it possible to change the angle of the output light. For this change to take place the light assembly mass centre is moved only slightly. Only optical components in the shape of lenses having a relatively small diameter need to be moved in relation to the front lens. By moving only internal optical components, it is possible to produce the light assembly as an essentially closed unit. Thus the air circulating through the light assembly can be controlled meaning that fresh air from the outside circulating the light deflecting means and the back of the front lens may be prevented or at least reduced. Hence the need for cleaning of the internal components is reduced.

A light assembly could comprise at least one adjustable light source forming a beam of light into light forming means, which light assembly comprises a front lens, where the light forming means at least comprises a light deflecting means for changing the light angle of the light beam after passing through the front lens, where the light deflecting means preferably comprises a central part that could differ from the surrounding parts of the light deflecting means, where the light deflecting means in a first position can spread out the angular distribution in the light beam in front of the front lens to generate a wide-angle light beam, where the light deflecting means in a second position the light beam is not effected by light deflecting means to generate a narrow-angle light beam, where the light deflecting means is connected with a first actuator, where the light deflecting means is movable between the first and the second position. In this way, it could be achieved that a quite ordinary front lens could be used because this ordinary front lens is cooperating with the light deflecting means which in one position is active so that the light just in front of the front lens is passing through the light deflecting means which could be diffusing the light. Only a very small part of the light will pass unchanged through the light deflecting means. In the opposite position, the light deflecting means will be moved into a position where it is essentially ineffective, and the light assembly will generate a relative narrow-angle light beam. By moving the actuating means, all positions between the nearly total diffusion of the light and the other situation where it generates a relative narrow-angle light beam, it will be possible to find any combination between these two positions where the output light beam can be changed in extremely small steps between the two situations.

The light deflecting means can be formed as a diffusing lens, which diffusing lens can comprise a central opening where the light beam passes through the opening for generating a narrow-angle light beam in the second position for the light deflecting means. It can hereby be achieved that the diffusion lens is totally out of influence in the position narrow. In the opposite position, only a very small part will pass through the central opening in the diffusion lens, and as such this light will not change the overall impression of the output light beam as being a diffused light beam.

The diffusing lens can be designed with an optical characteristic which changes in dependence of the axial distance to a centre of the diffusing lens. It could hereby be achieved that there will be a very soft change between the different situations. For example, the diffusing lenses can have a star formed opening in the central part of it where the stars make openings between the diffusing elements out to a certain diameter of the diffusion lens.

DETAILED DESCRIPTION OF THE INVENTION

Figure 2:
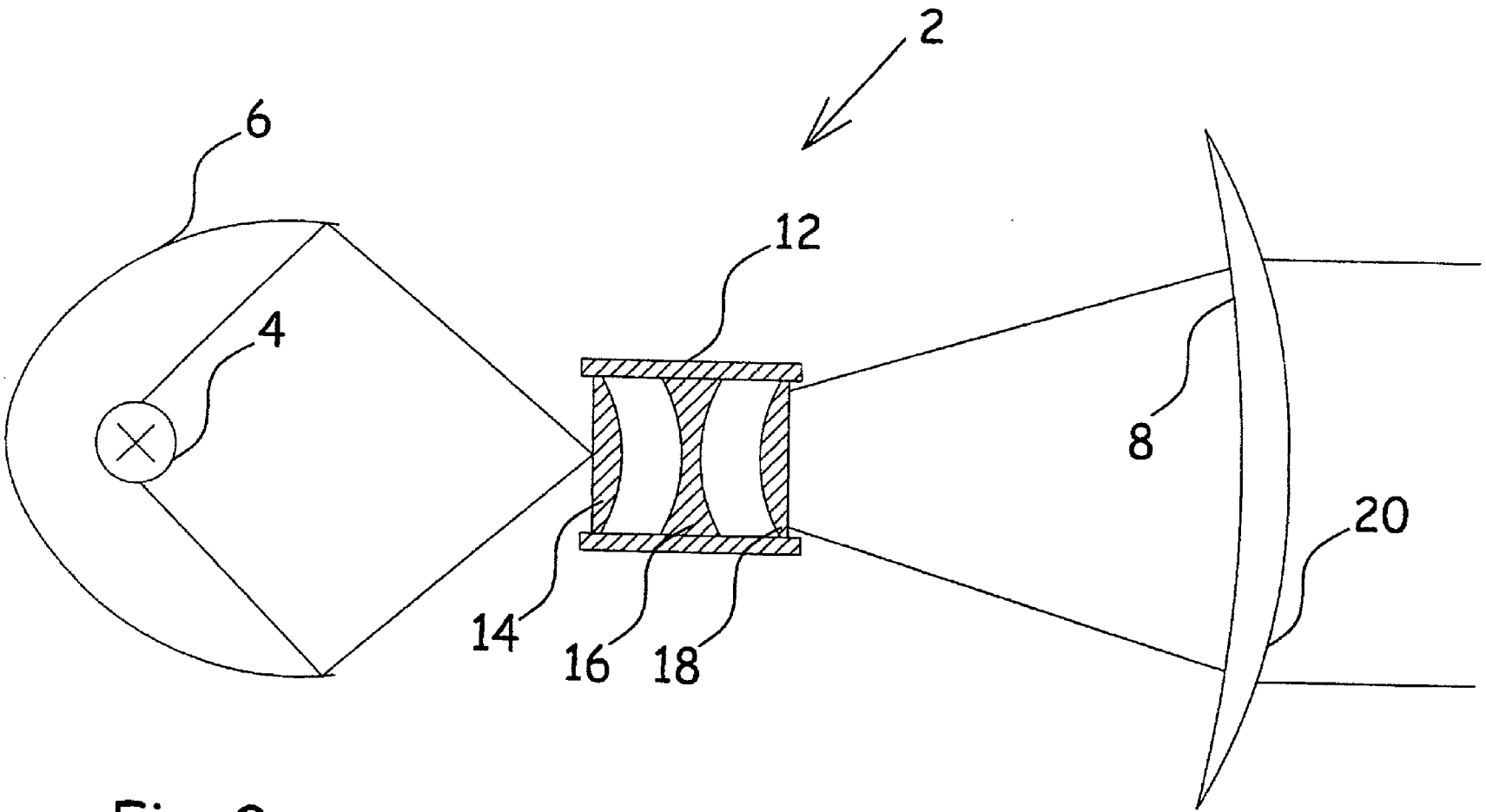
Figure 3:
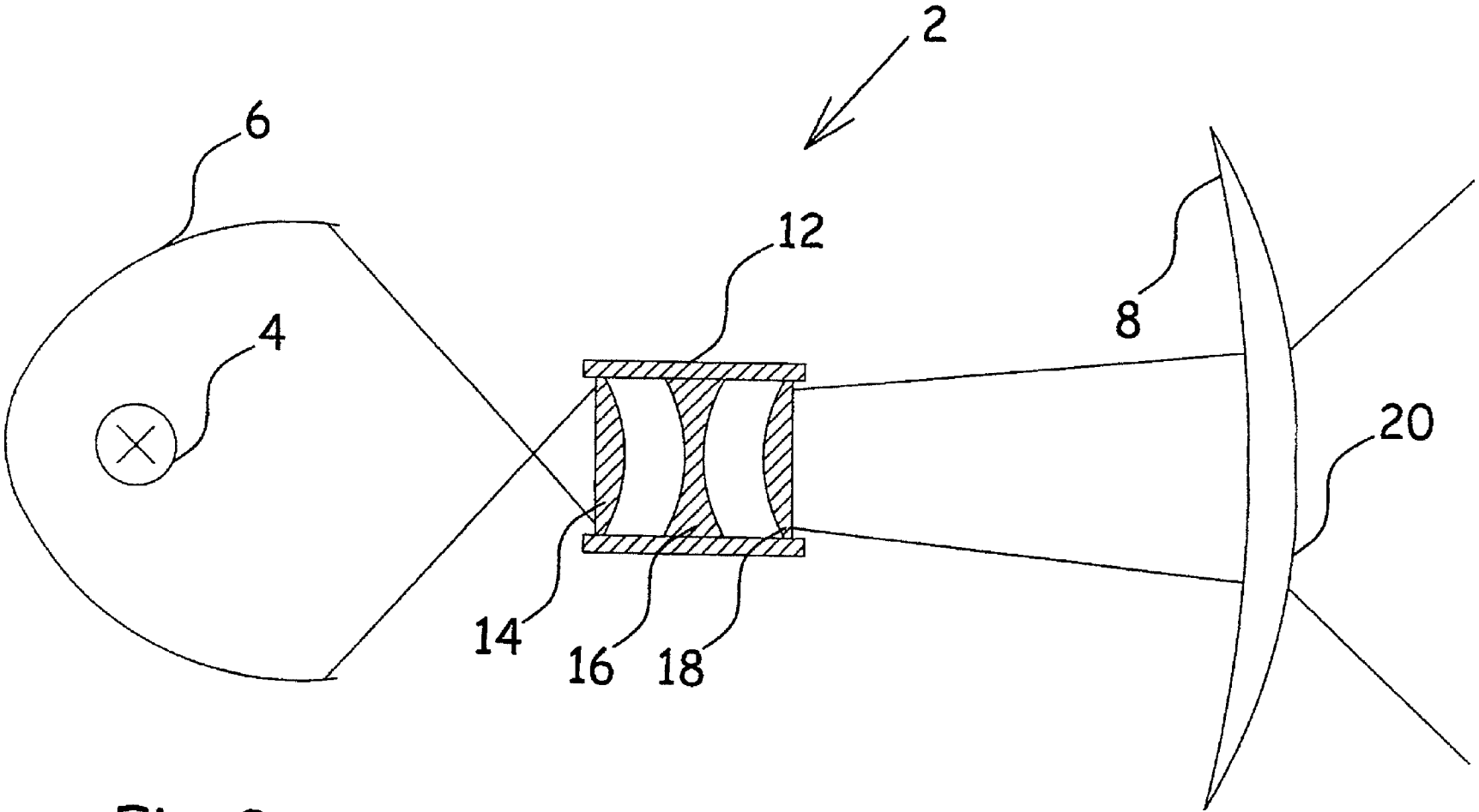
Figure 4:
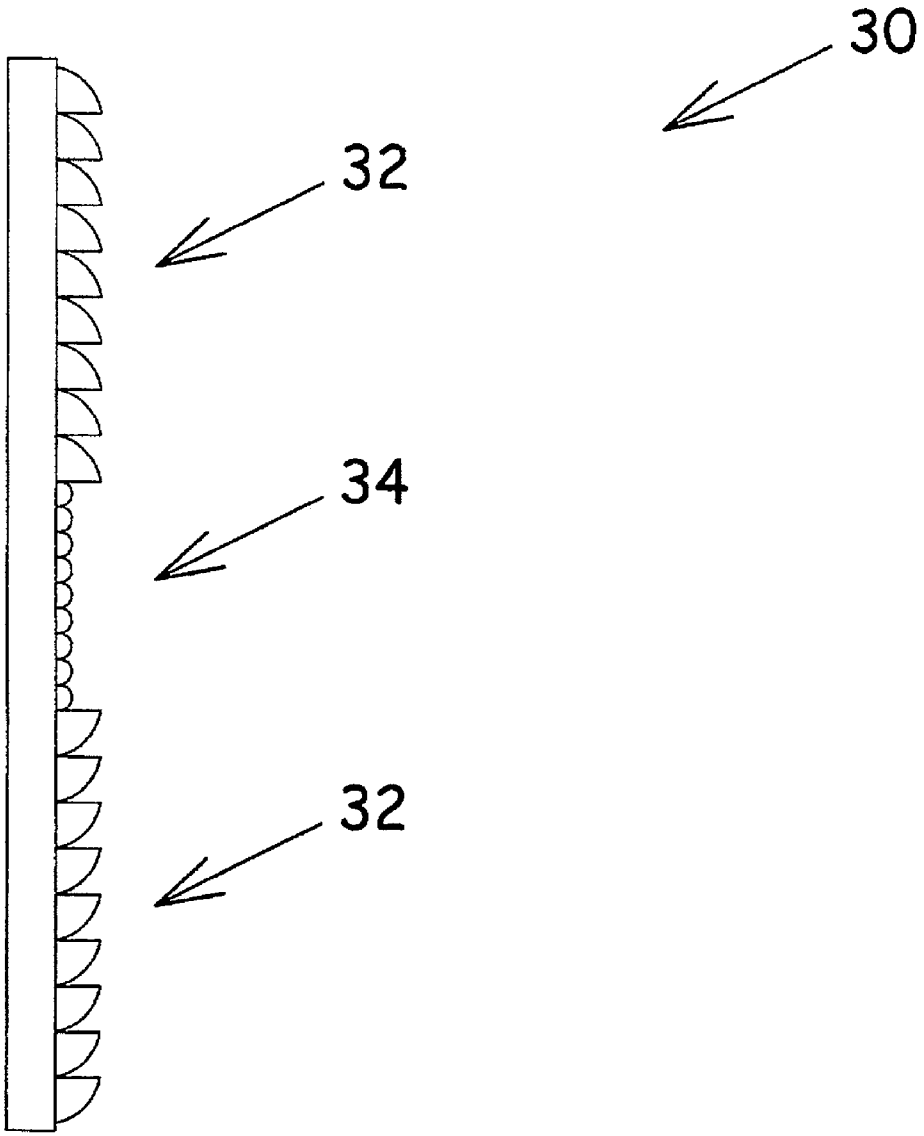
Figure 5:
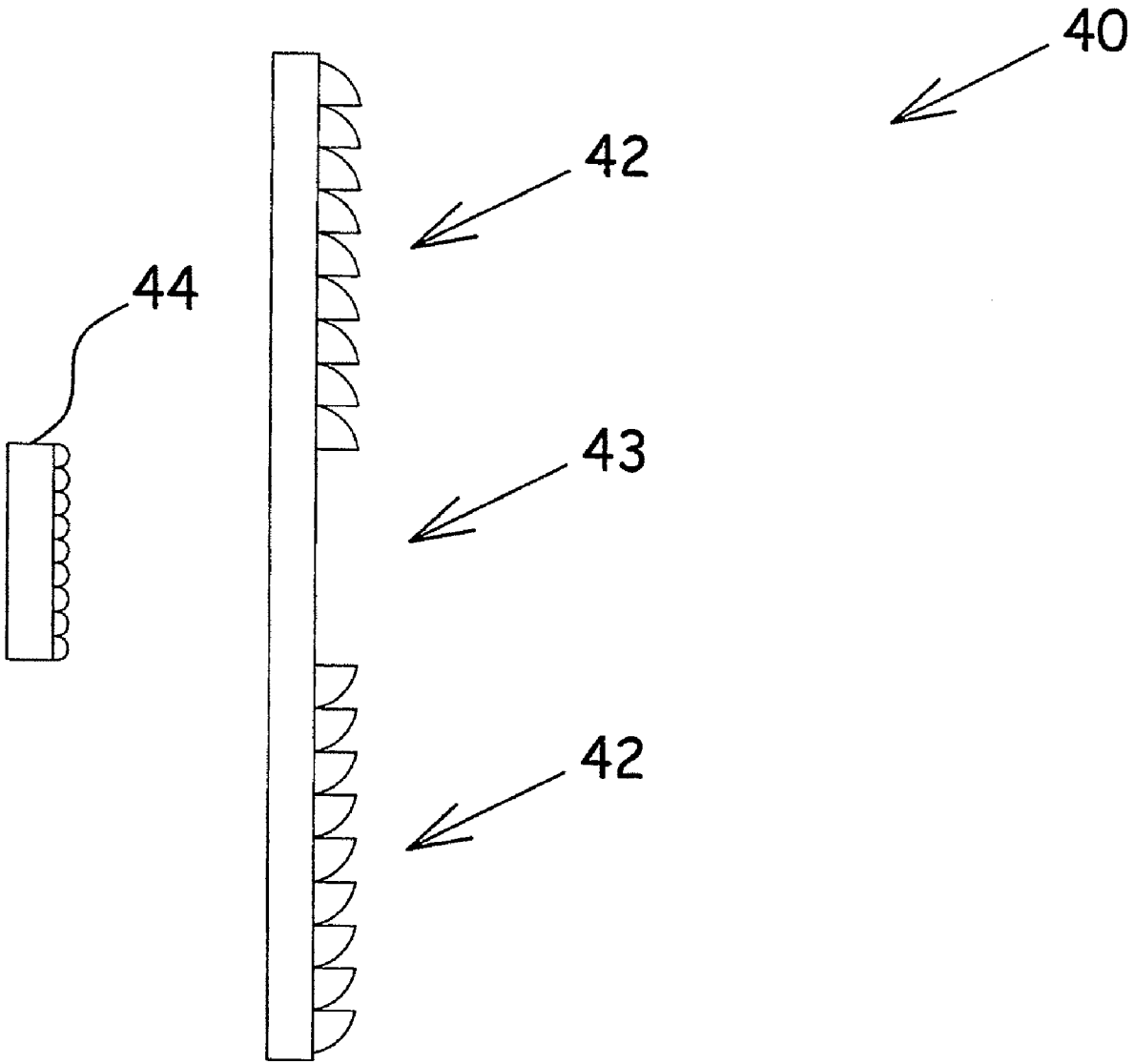
Figure 6:
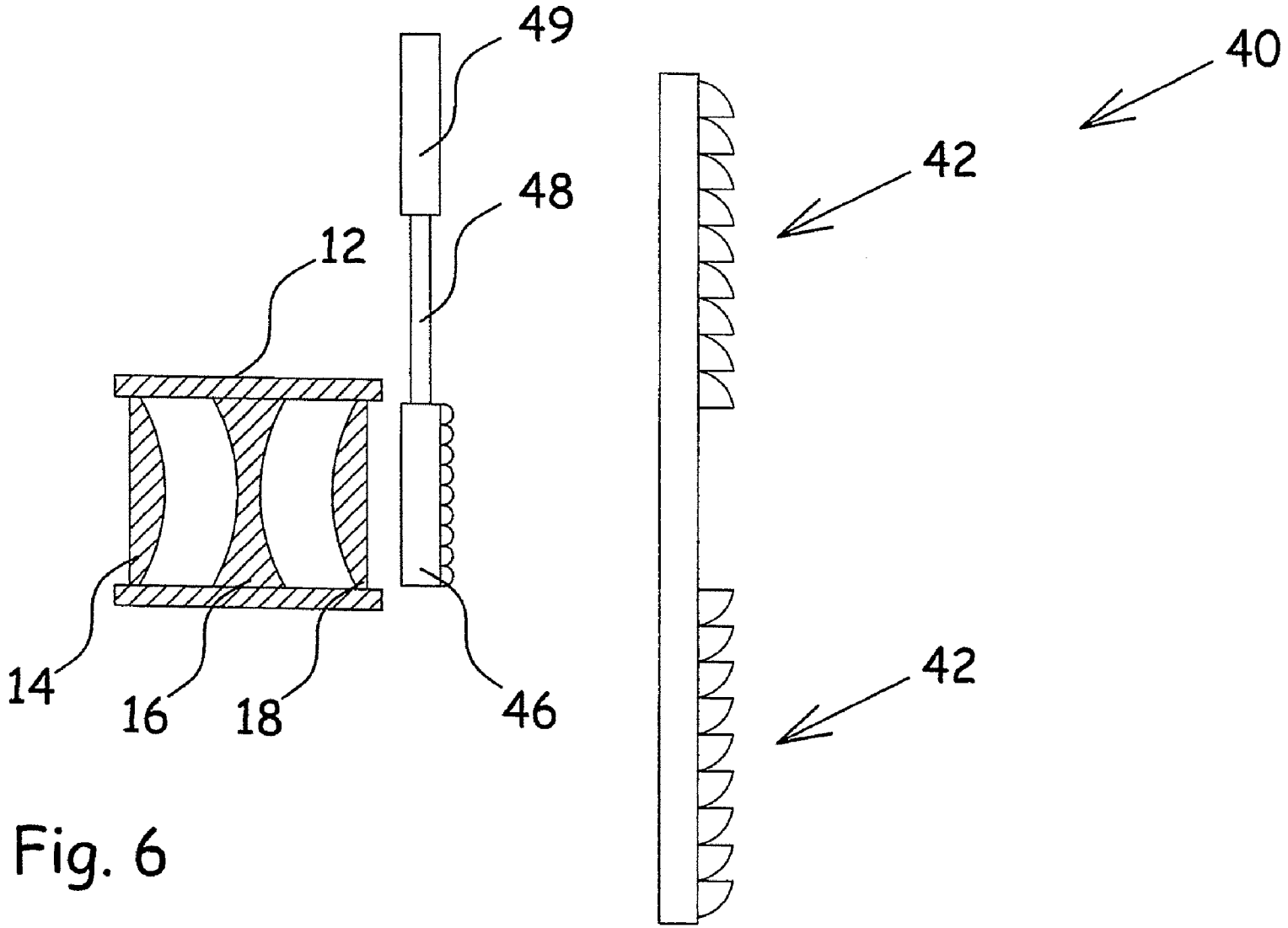
Figure 7:
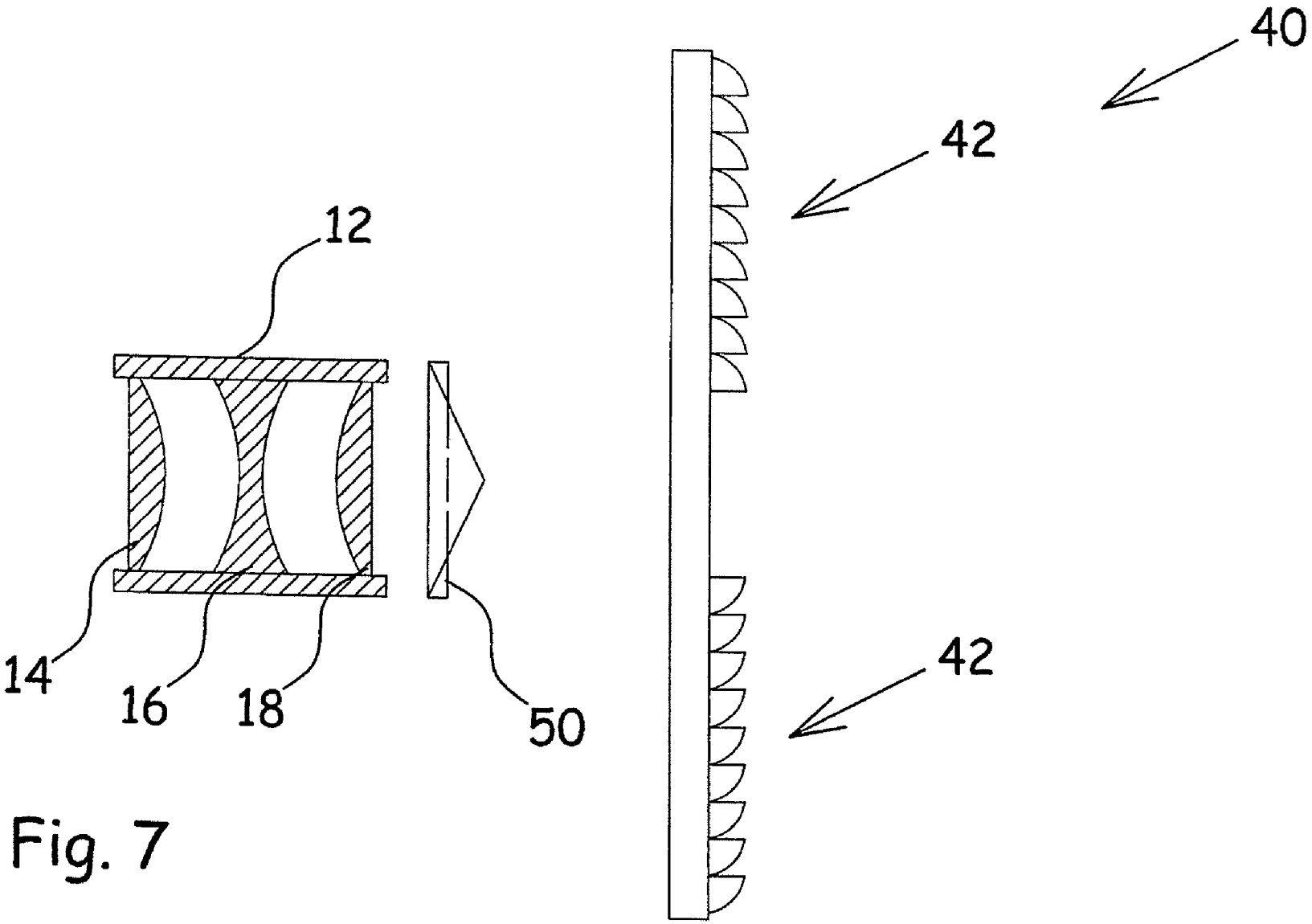
Figure 8:
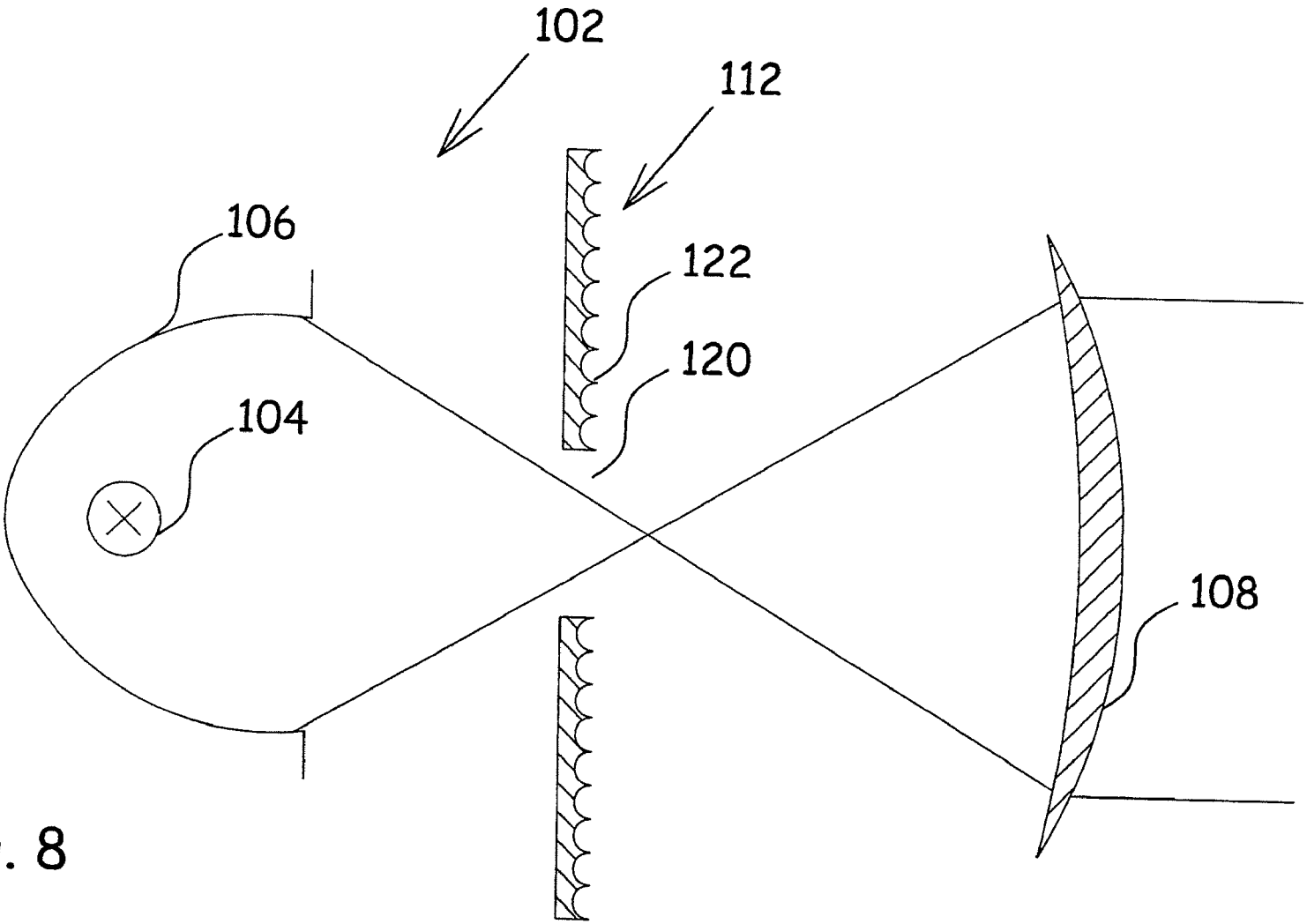
Figure 9:
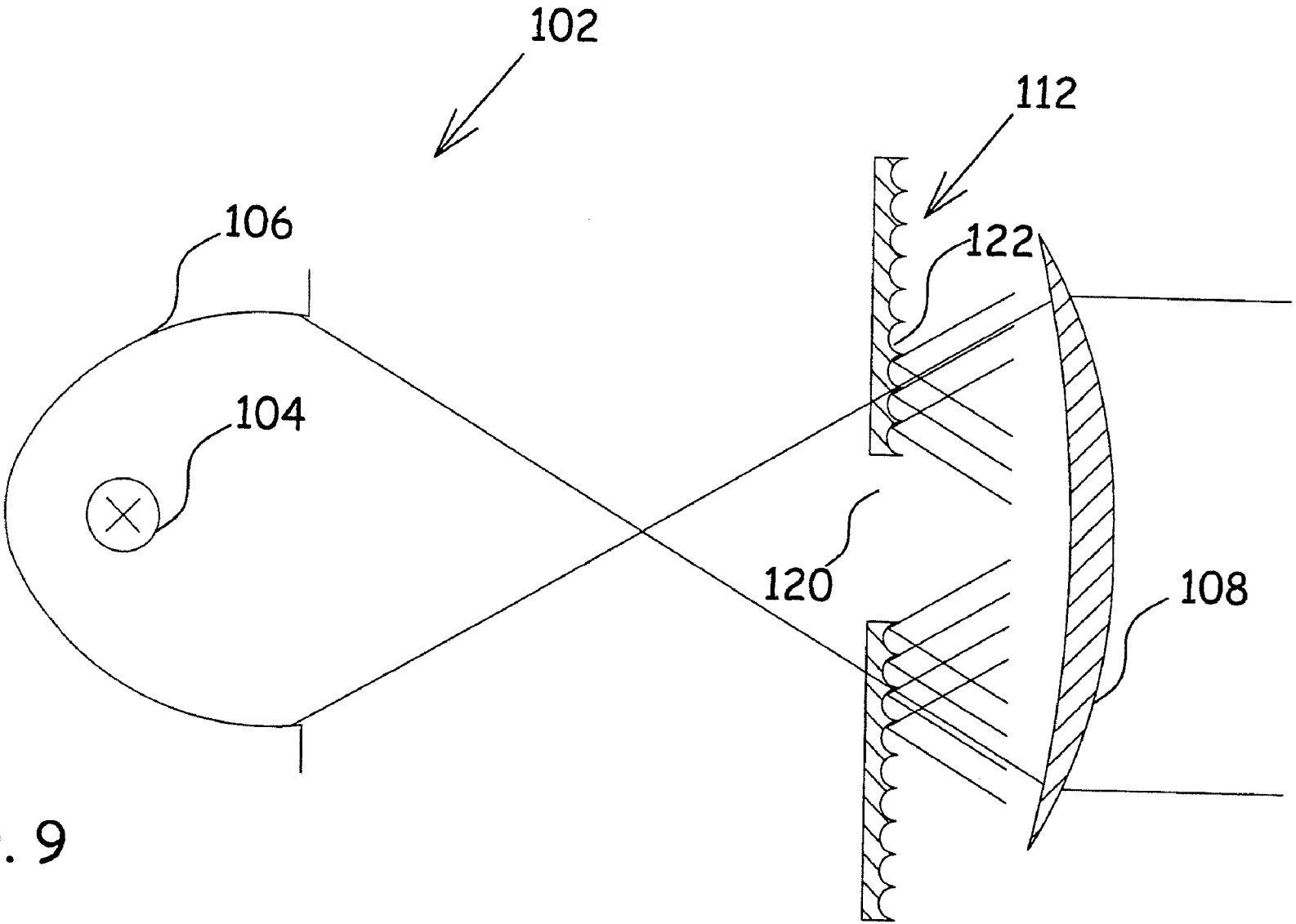

FIG. 1 shows a light assembly in a first position,

FIG. 2 shows the light assembly as described in FIG. 1 in a second position, FIG. 3 shows a third position of the light deflecting means, FIG. 4 shows one possible embodiment of a front lens, FIG. 5 shows a front lens comprising a fresnel section, FIG. 6 shows the front lens with the diffusion lens placed in conjunction with the light deflecting means, FIG. 7 shows the front lens and the light deflecting means, FIG. 8 shows a light assembly in a second embodiment of the invention in a narrow situation, and FIG. 9 also shows the same light assembly as FIG. 8, but in a wide position.

FIG. 1 shows a light assembly 2 comprising a lamp 4 placed in relation to a reflector 6. In the front end of the light assembly 2, a front lens 8 is placed. A light deflecting means 12 comprising at least the lenses 14, 16 and 18 is placed between the reflector 6 and the front lens 8. The front lens 8 comprises a central area 20 having different optical characteristics than the lens in the area surrounding the central area. During operation, the reflector 6 reflects the light emitted from the lamp 4 to concentrate the light inside the light deflecting means 12. Before the light enters the light deflecting means, it may pass colour changing means or light effect elements. The light leaving the light deflecting means 12 is spread out causing essentially the entire back of the front lens 8 to be illuminated. The front lens converge the light so a relatively narrow light beam leaves the light assembly 2.

FIG. 2 shows the light assembly as described in FIG. 1. The only difference is that the light deflecting means is moved in the direction towards the front lens 8.

During operation, the light leaving the light deflecting means hits only a part of the front lens 8. Hence the front lens spreads the light to illuminate a larger area in front of the light assembly 2.

FIG. 3 shows a third position of the light deflecting means 12. The other components are equal to the components of FIG. 1 and FIG. 2.

During operation, the light leaving the light deflecting means only hits the central part 12 of the front lens 8. As the front lens' central part has other optical characteristics than the rest of the lens, the light may be spread into a wide angle.

FIG. 4 shows one possible embodiment of a front lens 30. According to this embodiment the front lens 8 in FIGS. 1, 2 and 3 may be replaced by the front lens 30. The front lens 30 has an outer fresnel section 32 surrounding the central portion 34, which is formed as a diffusion lens.

If a light beam only hits the area 34, maximum diffusion effect is achieved. However, if the light hits the entire back of the front lens 30, the fresnel section 32 takes over and directs the light into a narrow beam. Of course, parts of the light still hit the diffusion section 34 and are spread out. The effect of the light is limited thus the generation of a narrow beam is not disturbed.

FIG. 5 shows a front lens 40 comprising a standard fresnel 42 lens where the central part has the same optical characteristics and the same effective focal length as the rest of the lens, where a diffusion lens 44 is placed behind the central part of the lens 42.

The effect is thus the same as if the diffusion lens 44 was placed on or as part of the front lens.

Furthermore, FIG. 6 shows the front lens 40, where, the diffusion lens 46 is placed in conjunction with the light deflecting means 12, which comprises lenses 14, 16 and 18.

During operation, the diffusion lens 46 is connected by a lever 48, which lever is connected to an actuator 49, which is able to move the diffusion lens 46 out of the light beam. This may result in different optical functions. Hard edge light is formed as in a spotlight by means of a combination of the light deflecting means 12 and the front lens 40. However, in case diffuse light is required, the actuator 49 places the diffusion lens 46 in front of the light deflecting means. Placing or replacing the diffusion lens 46 in or out of the light beam may take place in all positions for the light deflecting means, and thus it is possible to move the diffusion lens in or out of the light beam regardless of the light deflecting means.

Furthermore, FIG. 7 shows the front lens 40 and the light deflecting means 12, which comprises lenses 14, 16 and 18. In the light path, a rotating prism 50 is placed, which is placed in conjunction with the light deflecting means and may be moved in or out of the light beam by means of an actuator.

Thus the prism 50 can be placed in the light beam or be moved outside the light beam regardless of the position of the light deflecting means 12.

FIG. 8 shows a light assembly 102 in a narrow situation. The light assembly 102 comprises a light source 104, a reflector 106 and a front lens 108. The light forming means 112 has an opening 120 which opening is surrounded by diffusing elements 122.

As seen in FIG. 8, the light deflecting means 112 is not active because the light beam passes through the opening 120 and hits the inner surface of the front lens 108 and forms a narrow beam.

FIG. 9 also shows the light assembly 102 but in a wide position. The light deflecting means 112 is now placed close to the front lens 108. A great part of the light beam is now deflected by the diffusing elements 122 so that the light that leaves the front lens 108 is now wide-angled.

The light source could be an ordinary lamp placed in conjunction with a reflector, or the light source could instead be formed by one or more LEDs. As an alternative the light source could be a laser.

The invention claimed is:

1. A light assembly comprising:

at least one light source which generates a beam of light into a light forming means;

a movable light forming means at least comprising a light deflecting means for changing the angular and spatial distribution of the light hitting a front lens;

a front lens fixed in relation to the light source;

where the light deflecting means in a first position concentrates the light beam into the central part of the front lens to generate a wide-angle light beam;

in a second position distributes the light beam over essentially the entire front lens to generate a narrow-angle light beam;

the light deflecting means is movable between different positions;

wherein said central part of said front lens has optical properties which differs from that of the surrounding parts of said front lens.

2. A light assembly according to claim 1 wherein the light deflecting means is positioned by a first actuator.

3. A light assembly according to claim 1, wherein the central part of the front lens, has an optical characteristic which varies with respect to the position on the central part.

4. A light assembly according to claim 1, wherein the central part of the front lens is a diffusion lens.

5. A light assembly according to claim 1, wherein the light deflecting means comprises at least one lens with a positive power.

6. A light assembly according to claim 1, wherein a rotating beam shaper is mechanically connected to the light deflecting means, and wherein the rotating beam shaper is movable in and out of the light beam by means of a shaper actuator.

7. A light assembly comprising:

at least one light source which generates a beam of light into a light forming means;

a movable light forming means at least comprising a light deflecting means for changing the angular and spatial distribution of the light hitting a front lens;

a front lens fixed in relation to the light source;

wherein the light deflecting means in a first position, concentrates the light beam into a central part of the front-lens to generate a wide-angle light beam;

in a second position, distributes the light beam over essentially the entire front lens to generate a narrow-angle light beam;

is movable between at least said first and second positions by a first actuator;

wherein an additional optic component is located behind the central part of the front lens for obtaining different optical properties in the central part of the front lens, and wherein said different optical properties obtained in the central part of the front lens differ from optical properties of surrounding parts of said front lens.

8. A light assembly according to claim 7, wherein the additional optic component located behind the central part of the front lens is movable in and out of the light beam by means of a second actuator.

9. A light assembly according to claim 8, wherein a rotating beam shaper is mechanically connected to the light deflecting means, and wherein the rotating beam shaper is movable in and out of the light beam by means of a third actuator.

10. A light assembly according to claim 7, wherein the additional optics are mechanically connected to the light deflecting means, and wherein the additionally optics are movable in and out of the light beam by means of a second actuator.

11. A light assembly comprising:

a movable light forming means at least comprising a light deflecting means for changing the angular and spatial distribution of the light hitting the front lens, at least one light source which generates a beam of light into the light forming means, and a front lens fixed in relation to the light source;

wherein the movable light deflecting means has a central part that differs from the surrounding parts of the light deflecting means, wherein the light deflecting means in a first position spread out the angular distribution of the light beam to generate a wide-angle light beam, wherein the light deflecting means in a second position has none or only a limited effect on the light beam for generating a narrow-angle light beam, and wherein the light deflecting means is movable between at least said first and second positions.

12. A light assembly according to claim 11, wherein the light deflecting means is positioned by a first actuator.

13. A light assembly according to claim 11, wherein the light deflecting means has an optical characteristic which changes as function of the position on the light deflecting means.

14. A light assembly according to claim 11, wherein the light deflecting means is a diffusing lens, which diffusing lens comprises a central opening, and wherein the light beam passes through the opening for generating a narrow-angle light beam in the second position of the light deflecting means.

15. A method for forming a light beam, comprising the steps of:

generating light by means of a light generating means, transmitting the light generated into a light forming means which comprise at least light deflecting means for changing the angle of the light beam, using the light deflecting means in a first position so as to concentrate the light beam into the central part of a fixed front lens to generate a wide-angle light beam, said central part of said front lens having optical properties which differ from that of surrounding parts of said front lens, using the light deflecting means in a second position so as to concentrate the light beam over essentially the entire fixed front lens to generate a narrow-angle light beam, moving the light deflecting means movable between at least said first and second positions.

* * * * *